US009564675B2

(12) United States Patent
Yoon et al.

(10) Patent No.: US 9,564,675 B2
(45) Date of Patent: Feb. 7, 2017

(54) DISPLAY DEVICE HAVING ANTENNA

(71) Applicant: Samsung Display Co., Ltd., Yongin (KR)

(72) Inventors: Sangrock Yoon, Hwaseong (KR); Sunghwan Kim, Seoul (KR); Onsik Choi, Hwaseong-si (KR); Ung Choi, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 644 days.

(21) Appl. No.: 13/958,053

(22) Filed: Aug. 2, 2013

(65) Prior Publication Data

US 2014/0292588 A1 Oct. 2, 2014

(30) Foreign Application Priority Data

Apr. 2, 2013 (KR) ..... 10-2013-0035912

(51) Int. Cl.
*H01Q 1/22* (2006.01)
*H01Q 1/38* (2006.01)
*H01Q 21/28* (2006.01)

(52) U.S. Cl.
CPC ..... *H01Q 1/2266* (2013.01); *H01Q 1/2283* (2013.01); *H01Q 1/38* (2013.01); *H01Q 21/28* (2013.01)

(58) Field of Classification Search
CPC ..... H01Q 1/22; H01Q 1/2266; H01Q 1/2283; H01Q 1/38; H01Q 21/28
USPC ..... 343/702, 721; 361/679.21, 679.26, 361/679.27, 679.28
See application file for complete search history.

(56) References Cited

U.S. PATENT DOCUMENTS

| | | | | |
|---|---|---|---|---|
| 6,694,151 | B2 * | 2/2004 | Carlson | H01Q 1/22 348/14.02 |
| 7,269,393 | B2 | 9/2007 | Ota et al. | |
| 7,668,575 | B2 | 2/2010 | Park et al. | |
| 7,855,687 | B2 | 12/2010 | Kang | |
| 8,000,093 | B2 * | 8/2011 | Kim | G06F 1/1601 349/58 |
| 8,462,072 | B2 * | 6/2013 | Andrenko | H01Q 1/38 343/700 MS |
| 9,088,070 | B2 * | 7/2015 | Sato | G06F 1/1626 |
| 2008/0074334 | A1 * | 3/2008 | Kang | G02F 1/13452 343/702 |

FOREIGN PATENT DOCUMENTS

| | | |
|---|---|---|
| JP | 2005-250343 | 9/2005 |
| JP | 2010-102489 | 5/2010 |
| KR | 10-1024645 | 9/2005 |
| KR | 10-2006-0029616 | 4/2006 |
| KR | 10-2006-0044044 | 5/2006 |
| KR | 10-0669665 | 9/2006 |
| KR | 10-0806108 | 3/2007 |
| KR | 10-2007-0055776 | 5/2007 |

(Continued)

*Primary Examiner* — Tho G Phan
(74) *Attorney, Agent, or Firm* — H.C. Park & Associates, PLC

(57) ABSTRACT

A display device includes a display panel which displays an image, a driving circuit substrate disposed on a rear surface of the display panel and controlling the display panel to display the image, and a chip antenna connected to an end portion of the driving circuit substrate in a longitudinal direction of the driving circuit substrate.

13 Claims, 5 Drawing Sheets

(56) References Cited

FOREIGN PATENT DOCUMENTS

| | | |
|---|---|---|
| KR | 10-0768505 | 10/2007 |
| KR | 10-2007-0117051 | 12/2007 |
| KR | 10-2008-0022612 | 3/2008 |
| KR | 10-2011-0069339 | 6/2011 |

* cited by examiner

DISPLAY DEVICE HAVING ANTENNA

CROSS-REFERENCE TO RELATED APPLICATION

This application claims priority from and the benefit of Korean Patent Application No. 10-2013-0035912, filed on Apr. 2, 2013, which is hereby incorporated by reference for all purposes as if fully set forth herein.

BACKGROUND

Field

Exemplary embodiments of the present invention relate to a display device that displays an image. More particularly, the exemplary embodiments relate to a display device having an antenna.

Discussion of the Background

In recent years, various display devices, such as a liquid crystal display, a field emission display, a plasma display panel, an organic light emitting display, etc., have been widely used.

The display devices are applied to various image display devices, e.g., a television set, a computer monitor, etc., to display images or texts. In particular, an active matrix liquid crystal display, which drives a liquid crystal cell by using a thin film transistor, has advantages, such as superior image quality, low power consumption, etc., and has been recently scaled-up and redesigned with higher resolution for better image quality.

In general, the display device is applied to not only computer monitors and television sets, but also to portable notebook computers. The notebook computer is required to be slim and light weight.

In recent years, notebook computers have often been equipped with a wireless communication capability. For wireless communication, the notebook computer is generally required to include an antenna. The notebook computer is generally configured to include a computer system module and a display part. Thus, an antenna to be installed on the display part should be capable of providing enhanced transmitting and receiving efficiency for wireless signals.

SUMMARY

Exemplary embodiments of the present invention provide a display device capable of reducing the size of an antenna applied thereto.

Additional features of the invention will be set forth in the description which follows, and in part will be apparent from the description, or may be learned by practice of the invention.

An exemplary embodiment of the present invention discloses a display device including a display panel that displays an image, a driving circuit substrate disposed on a rear surface of the display panel and controlling the display panel to display the image, and an antenna connected to an end portion of the driving circuit substrate in a longitudinal direction of the driving circuit substrate.

An exemplary embodiment of the present invention also discloses a display device including a display panel that displays an image, a driving circuit substrate disposed on a rear surface of the display panel and controlling the display panel to display the image, a protective cover coupled to the display panel while interposing the driving circuit substrate there between to protect the driving circuit substrate, and an antenna pattern part attached to the protective cover to transmit and receive a wireless signal.

It is to be understood that both the foregoing general description and the following detailed description are exemplary and explanatory and are included to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
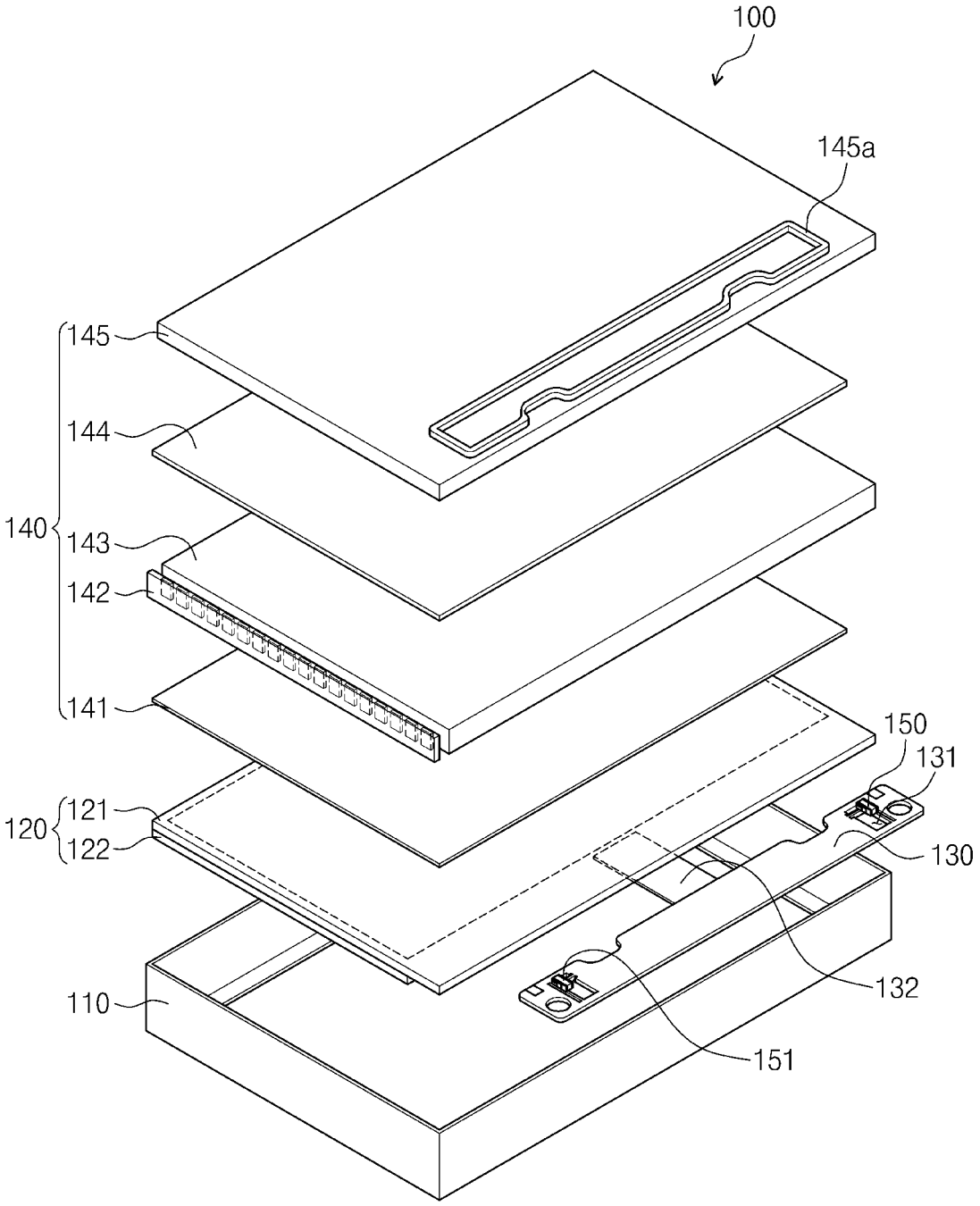
FIG. 1 is an exploded perspective view showing a liquid crystal display according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on", "connected to", or "coupled to" another element or layer, it can be directly on, connected to, or coupled to the other element or layer, or intervening elements or layers may be present. In contrast, when an element is referred to as being "directly on", "directly connected to", or "directly coupled to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ). As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The present invention will be explained in detail with reference to the accompanying drawings.

Hereinafter, although a liquid crystal display will be described as a representative example, the following exemplary embodiments may be applied to various display devices, such as a light emitting diode display, an organic light emitting diode display, a plasma display, an electrophoretic display, an electrowetting display, a vacuum fluorescent display, a field emission display, an electroluminescence display, etc.

FIG. 1 is an exploded perspective view showing a liquid crystal display according to an exemplary embodiment of the present invention.

Referring to FIG. 1, a liquid crystal display 100 includes a receiving container 110, a display panel 120, a driving circuit substrate 130, and a backlight assembly 140.

The display panel 120 includes a first display substrate 121 including gate lines, data lines, thin film transistors, and pixel electrodes, and a second display substrate 122 including a black matrix and a common electrode and being disposed to face the first display substrate 121. According to exemplary embodiments, the black matrix and the common electrode may be disposed on the first display substrate 121. The display panel 120 receives light from the backlight assembly 140 and displays the image. According to exemplary embodiments, the display panel 120 further includes polarizing films (not shown) respectively disposed on upper and lower surfaces thereof. The display panel 120 is electrically connected to the driving circuit substrate 130.

The backlight assembly 140 includes an optical sheet 141, a backlight unit 142, a light guide plate 143, a reflection sheet 144, and a mold frame 145. The backlight unit 142 is disposed adjacent to a side surface of the light guide plate 143. The light guide plate 143 guides the light provided from the backlight unit 142 to the display panel 120. The light guide plate 143 may have a plate shape and may be formed of a transparent material, e.g., glass or plastic. For instance, the light guide plate 143 may be formed an acrylic resin, e.g., polymethyl methacrylate (PMMA), or polycarbonate. When the light is incident to the light guide plate 143 through the side surface, the light is totally reflected at upper and lower surfaces of the light guide plate 143, and thus the light is contained within the light guide plate 143.

A diffusion pattern (not shown) may be formed on at least one of the upper surface or the lower surface of the light guide plate 143 such that the light dispersed in the light guide plate 143 travels toward the display panel 120 after exiting from the light guide plate 143. The diffusion pattern may be formed on the lower surface of the light guide plate 143. That is, the light traveling through the light guide plate 143 is reflected by the diffusion pattern, and then exits outside the light guide plate 143 through the upper surface of the light guide plate 143.

The backlight unit 142 is disposed adjacent to the side surface of the light guide plate 143. In this structure, the light guide plate 143 has a flat shape with a uniform thickness to uniformly provide the light to the entire of the display panel 120, but it should not be limited thereto. The backlight unit 142 disposed adjacent to the side surface includes a plurality of light emitting blocks, each emitting light.

The reflection sheet 144 is disposed on a first surface of the light guide plate 143 to reflect the light exiting from the light guide plate 143 toward a second surface of the light guide plate 143. That is, the reflection sheet 144 reflects the light not reflected by the diffusion pattern formed on the first surface of the light guide plate 143 to an exit surface of the light guide plate 143, thereby preventing the loss of the light incident to the light guide plate 143 while the light is guided by the light guide plate 143. This results in improved uniformity of the light exiting from the exiting surface of the light guide plate.

The optical sheets 141 are disposed on the second surface of the light guide plate 143 to diffuse and condense the light provided by the light guide plate 143. To this end, the optical sheets 141 include a diffusion sheet, a prism sheet, and a protective sheet. The diffusion sheet is disposed between the light guide plate 143 and the prism sheet to diffuse the light provided from the light guide plate 143, to thereby prevent the light from being concentrated. The prism sheet is configured to include prisms arranged on an upper surface thereof and may be provided as two sheets. Two prism sheets have the prisms arranged in different directions and condense the light diffused by the diffusion sheet to travel toward a direction perpendicular to the display panel 120. Accordingly, the light passing through the prism sheet travels in the perpendicular direction, so that brightness may be uniform on the protective sheet. The protective sheet disposed on the prism sheet protects the surface of the prism sheet and diffuses the light provided from the prism sheet to improve the uniformity of the distribution of the light. The optical sheets 141 should not be limited to the above-mentioned structure. That is, the structure of the optical sheets 141 may be changed depending on the specification of the liquid crystal display 100.

The display panel 120 is disposed on the protective sheet and accommodated in the receiving container 110 together with the backlight assembly 140. The receiving container 110 includes a bottom portion and a sidewall portion formed along an edge of the bottom portion to provide a receiving space in which the display panel 120 and the backlight assembly 140 are accommodated and prevent the backlight assembly 140 including the sheets from being bent. In addition, the driving circuit substrate 130 is electrically connected to the display panel 120 and bent along an outer surface of the mold frame 145, so that the driving circuit substrate 130 is placed on a rear surface of the mold frame 145. The mold frame 145 has a rectangular box shape and one surface thereof is opened. The display panel 120 and the backlight assembly are accommodated in and supported by the mold frame 145.

The mold frame 145 serves as a rear surface of the liquid crystal display 100, and a support rib 145*a* is disposed on the surface of the mold frame 145, which partially makes contact with the driving circuit substrate 130 and supports the driving circuit substrate 130. The support rib 145*a* prevents chips mounted on the driving circuit substrate 130 from being damaged by the mold frame 145 when the driving circuit substrate 130 makes contact with the mold frame 145. The support rib 145*a* may have various shapes.

The receiving container 110 has a rectangular shape like the mold frame 145, and one surface thereof is opened to expose the display panel 120. In addition, the receiving container 110 is coupled with the mold frame 145 such that a sidewall portion thereof covers the sidewall portion of the mold frame 145.

The driving circuit substrate 130 is connected to the display panel 120 through a flexible printed circuit board 132. The driving circuit substrate 130 is configured to include a printed circuit board, and various parts are mounted on the driving circuit substrate 130 to control the display panel 120 that displays the image. In particular, the driving circuit substrate 130 includes a first antenna 150 and a second antenna 151. In the present exemplary embodiment, the first antenna 150 serves as a main antenna and the second antenna 151 serves as an auxiliary antenna. The driving circuit substrate 130 may instead include only the first antenna 150.

In recent years, a wireless communication technology has advanced, and electronic devices are required to receive various frequencies. In particular, the liquid crystal display 100 employing a multiple-input-multiple-output (MIMO) communication system may include not only the first antenna 150 but also the second antenna 151. In the present exemplary embodiment, each of the first and second antennas 150 and 151 is configured to include a chip antenna. The driving circuit substrate 130 may serve as a ground for the first and second antennas 150 and 151.

The first antenna 150 and the second antenna 151 are designed to receive one or more signals through various wireless communication systems, e.g., long term evolution (LTE), WiMax, global system for mobile communication (GSM), code division multiple access (CDMA), bluetooth, Near field communication (NFC), WiFi, radio frequency identification (RFID), etc.

Figure 2:
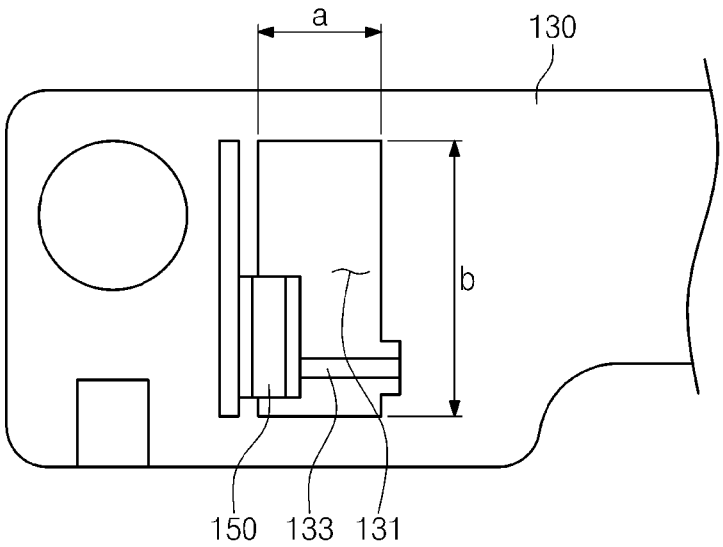
FIG. 2 is an enlarged plan view showing a portion of a driving circuit substrate and a first antenna shown in FIG. 1.
Figure 3:
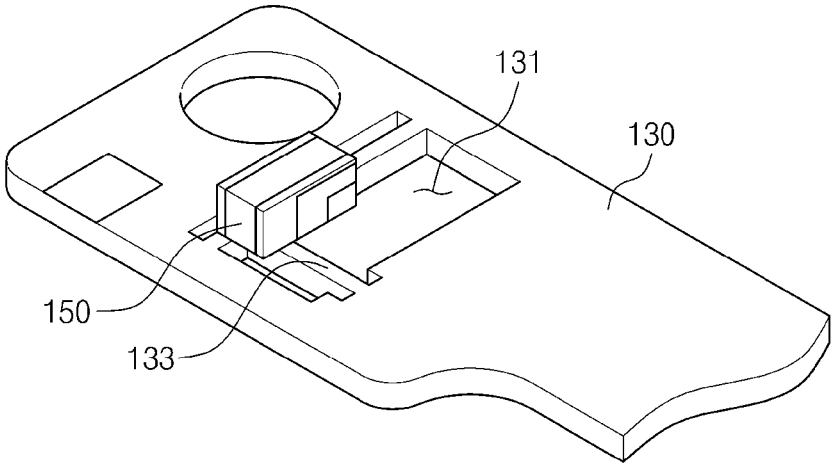
FIG. 3 is an enlarged perspective view showing a portion of a driving circuit substrate and a first antenna shown in FIG. 1.

FIG. 2 is an enlarged plan view showing a portion of the driving circuit substrate and the first antenna shown in FIG. 1, and FIG. 3 is an enlarged perspective view showing the portion of the driving circuit substrate and the first antenna shown in FIG. 1.

Referring to FIGS. 2 and 3, an opening portion 131 is formed through an end portion of the driving circuit substrate 130 in a longitudinal direction of the driving circuit substrate 130. In addition, the driving circuit substrate 130 includes a coupling portion 133 formed crossing the opening portion 131. The first antenna 150 is disposed above the opening portion 131 of the driving circuit substrate 130 to overlap with a portion of the driving circuit substrate 130 and the coupling portion 133.

The opening portion 131 may have a length "a" of about 2.8 mm in the longitudinal direction of the driving circuit substrate 130 and a width "b" of about 6.5 mm in a width direction of the driving circuit substrate 130. The size of the opening portion 131 may be changed depending on the size of the driving circuit substrate 130 and a radiation property of the first antenna 150.

Each of the first and second antennas 150 and 151 shown in FIG. 1 may be a dielectric type chip antenna or a helical monopole type chip antenna. When the first antenna 150 is the dielectric type chip antenna, the first antenna 150 may have a length of about 1.5 mm in the longitudinal direction of the driving circuit substrate 130, a width of about 3.0 mm in the width direction of the driving circuit substrate 130, and a height of about 1.2 mm. In this case, the length and width of the first antenna 150 in the longitudinal direction and the width direction of the driving circuit substrate 130, respectively, are less than the length "a" and width "b" of the opening portion 131, respectively.

When the first antenna 150 is the helical monopole type chip antenna, the first antenna 150 may have a length of about 2.0 mm in the longitudinal direction of the driving circuit substrate 130, a width of about 6.0 mm in the width direction of the driving circuit substrate 130, and a height of about 1.2 mm.

The first antenna 150 is directly mounted on the surface of the driving circuit substrate 130 and electrically connected to the flexible printed circuit board 132 through the coupling portion 133. In particular, because the first and second antennas 150 and 151 are relatively small, the size of the driving circuit substrate 130 may be reduced. In addition, the first and second antennas 150 and 151 are located at the end portion of the driving circuit substrate 130 in the longitudinal direction, and thus the driving circuit substrate 130 and the liquid crystal display 100 may be designed in accordance with the standard required by video electronics standards association (VESA).

Figure 4:
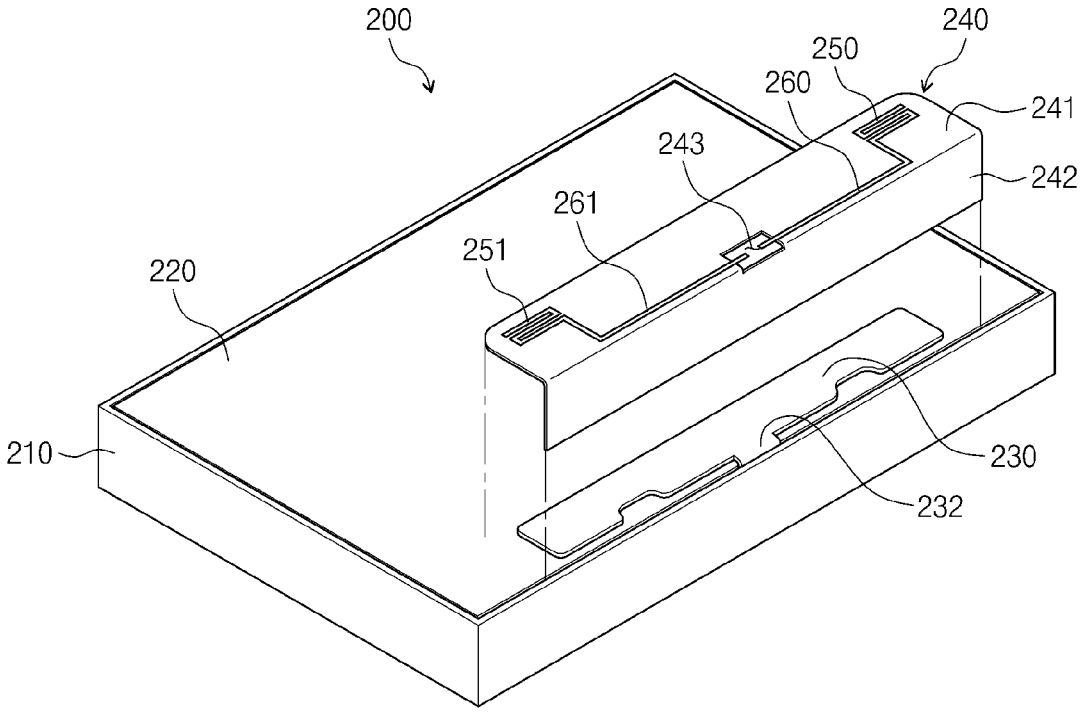
FIG. 4 is a perspective view showing a liquid crystal display according to another exemplary embodiment of the present invention.

FIG. 4 is a perspective view showing a liquid crystal display according to another exemplary embodiment of the present invention.

Referring to FIG. 4, a liquid crystal display 200 includes a receiving container 210, a mold frame 220, a driving circuit substrate 230, and a protective cover 240. Although not shown in FIG. 4, a display panel, a backlight assembly, and a mold frame 220 are accommodated in the receiving container 210. The receiving container 210 is coupled with the mold frame 220 to allow a sidewall portion of the receiving container 210 to cover a sidewall portion of the mold frame 220. The mold frame 220 provides a rear surface of the liquid crystal display 100 and the driving circuit substrate 230 is attached to the mold frame 220.

The protective cover 240 is disposed on a rear surface of the driving circuit substrate 230 to be coupled to the mold frame 220 while interposing the driving circuit substrate 230 there between. The protective cover 240 includes a rear portion 241 that covers the rear surface of the driving circuit substrate 230 to protect the driving circuit substrate 230 and a side portion 242 bent from the rear portion 241 and coupled with the receiving container 210.

The rear portion 241 of the protective cover 240 has a size and a shape which are appropriate to cover the entire area of the rear surface of the driving circuit substrate 230, and may be formed of polyethylene terephthalate. The protective cover 240 may be fixed to the mold frame 220 and the receiving container 210 by using an adhesive tape or a screw. Thus, the protective cover 240 is securely fixed to the display panel 200, so that movement of the driving circuit substrate 230 may be prevented.

A first antenna 250 and a second antenna 251 may be pattern antennas formed by using a metal thin film layer and arranged on the rear portion 241 of the protective cover 240. The first and second antennas 250 and 251 are disposed at an end portion in a longitudinal direction of the rear portion 241. In addition, the first and second antennas 250 and 251 are electrically connected to a flexible printed circuit board 232 through a first cable 260 and a second cable 261, respectively. The first and second cables 260 and 261 are disposed on the rear portion 241 of the protective cover 240. The protective cover 240 is provided with a window 243 formed there through to partially expose the rear portion 241 and the side portion 242, and thus the first and second cables 260 and 261 are electrically connected to the flexible printed circuit board 232.

Figure 5:
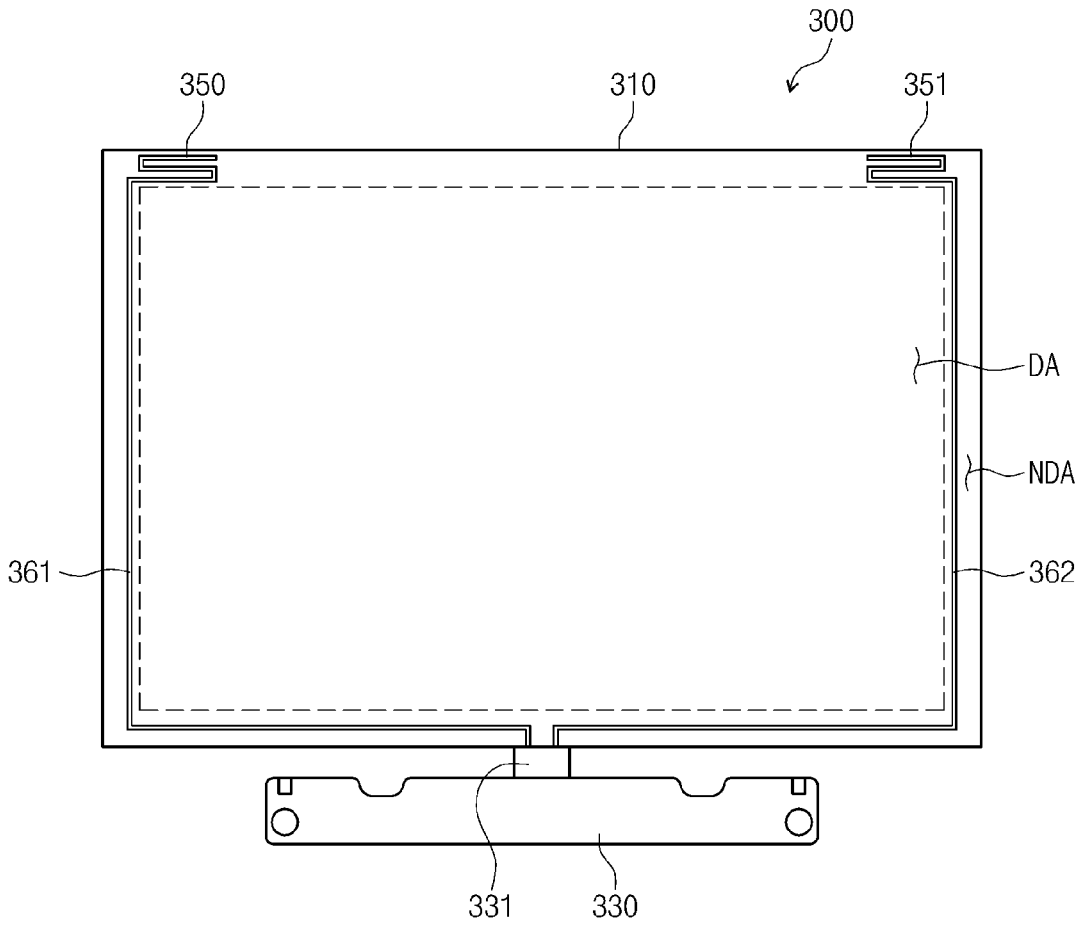
FIG. 5 is a plan view showing a liquid crystal display according to another exemplary embodiment of the present invention.

FIG. 5 is a plan view showing a liquid crystal display according to another exemplary embodiment of the present disclosure.

Referring to FIG. 5, a liquid crystal display 300 includes a display panel 310 and a driving circuit substrate 330. The display panel 310 and the driving circuit substrate 330 are electrically connected to each other through a flexible printed circuit board 331.

The display panel 310 includes a display area DA in which a plurality of pixels are arranged and a non-display area NDA disposed adjacent to the display area DA. The image is displayed in the display area DA and not displayed in the non-display area NDA. The display panel 310 may be a glass substrate, a silicon substrate, or a film substrate. Circuits realized by using an oxide semiconductor, amorphous semiconductor, crystalline semiconductor, or polycrystalline semiconductor are integrated in the non-display area NDA in order to apply signals to the pixels.

A first antenna 350 and a second antenna 351 are disposed in an area of the non-display area 310. The first and second antennas 350 and 351 may be pattern antennas formed by using a metal thin film layer. The first and second antennas 350 and 351 are electrically connected to a flexible printed circuit board 331 through a first cable 361 and a second cable 362, respectively. The first and second cables 361 and 362 are arranged in the non-display area NDA of the display panel 310.

Figure 6:
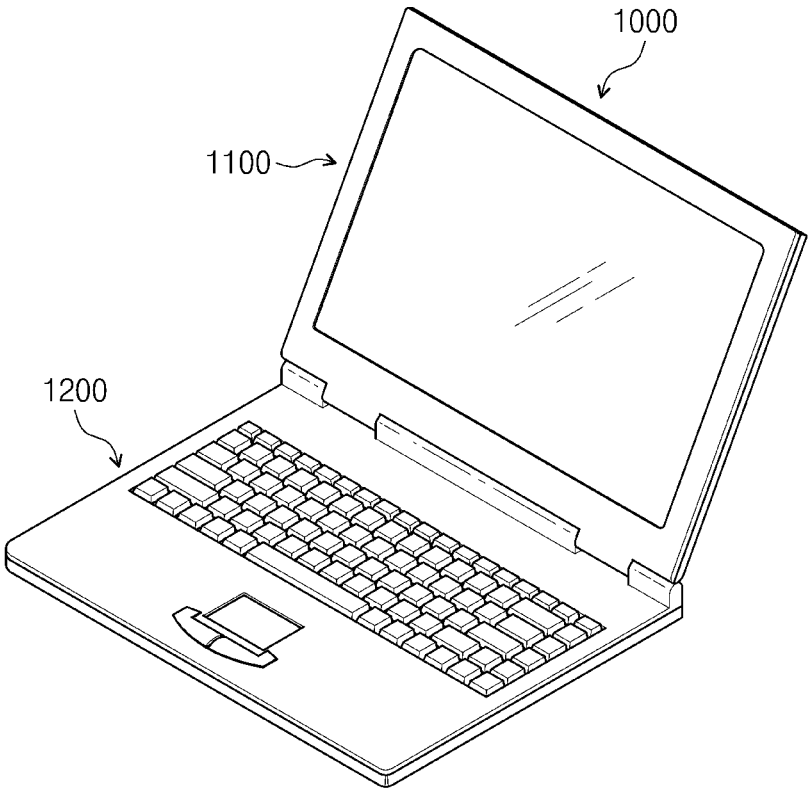
FIG. 6 is a front perspective view showing a notebook computer employing a liquid crystal display according to an exemplary embodiment of the present invention.

FIG. 6 is a front perspective view showing a notebook computer employing a liquid crystal display according to an exemplary embodiment of the present invention.

Referring to FIG. 6, a notebook computer 1000 includes a liquid crystal display 1100 and a computer system 1200. The liquid crystal display 1100 may be one of the liquid crystal displays 100, 200, and 300 shown in FIGS. 1 to 5. The computer system 1200 includes a data input device, such as a keyboard, a mouse, etc., a data processing and storing device, such as a central processing unit, a graphic card, a memory, etc., and a communication device, such as an infrared ray communication port, a wireless LAN, etc.

The liquid crystal display 1100 includes an antenna for a wireless communication, and a wireless signal received through the antenna is provided to the computer system 1200. In particular, when the liquid crystal display 100 shown in FIG. 1 is used as the liquid crystal display 1100, small-sized chip antennas 150 and 151 may be mounted on the driving circuit substrate 130. Thus, the liquid crystal display 1100 may be slimmed and light-weighted.

Further, inclusion of the antenna in the liquid crystal display 1100 may reduce or prevent the possibility of electromagnetic interference generated by the computer system 120.

According to the above, the chip antenna is disposed on the printed circuit board, and thus the size of the display device may be reduced. Thus, the size of portable electronic devices, e.g., a notebook, may be reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel configured to display an image;

a driving circuit substrate disposed on a rear surface of the display panel and configured to control the display panel to display the image; and an antenna connected to a longitudinal end portion of the driving circuit substrate, wherein:

the driving circuit substrate comprises a printed circuit board having an opening; and the antenna is disposed above the opening.

2. The display device of claim 1, wherein the printed circuit board is configured to provide a ground for the antenna.

3. The display device of claim 2, wherein the printed circuit board comprises a coupling portion crossing the opening, and the antenna is electrically connected to the printed circuit board through the coupling portion.

4. The display device of claim 3, wherein the opening is disposed at, at least one of both longitudinal end portions of the printed circuit board.

5. The display device of claim 4, wherein the opening has a length of about 2.8 mm in the longitudinal direction of the printed circuit board and a width of about 6.5 mm in a width direction of the printed circuit board.

6. The display device of claim 5, wherein the antenna is shorter than the printed circuit board in both the length direction and the width direction of the printed circuit board.

7. The display device of claim 6, wherein the antenna has a length of about 1.5 mm in the length direction of the printed circuit board, a width of about 3.0 mm in the width direction of the printed circuit board, and a height of about 1.2 mm.

8. The display device of claim 7, wherein the antenna comprises a dielectric chip antenna.

9. The display device of claim 6, wherein the antenna has a length of about 2.0 mm in the longitudinal direction of the printed circuit board, a width of about 6.0 mm in the width direction of the printed circuit board, and a height of about 1.2 mm.

10. The display device of claim 9, wherein the antenna comprises a helical monopole chip antenna.

11. The display device of claim 1, wherein the antenna comprises first and second antennas respectively disposed at both longitudinal end portions of the driving circuit substrate.

12. The display device of claim 1, further comprising:

driving integrated circuits (ICs) mounted on the printed circuit board; and a backlight assembly disposed on the rear surface of the display panel and configured to supply a light to the display panel.

13. The display device of claim 1, wherein the antenna comprises a chip antenna.

* * * * *